United States Patent [19]

Aydelott et al.

[11] 4,103,738

[45] Aug. 1, 1978

[54] REPLACEABLE INLET MEANS FOR HEAT EXCHANGER

[75] Inventors: Max M. Aydelott, West Covina; Richard L. Hartman, Hacienda Heights; James A. York, Glendale, all of Calif.

[73] Assignee: Smith Engineering Company, South El Monte, Calif.

[21] Appl. No.: 714,377

[22] Filed: Aug. 16, 1976

[51] Int. Cl.[2] ..... F28F 19/06; F28F 9/02

[52] U.S. Cl. ..... 165/178

[58] Field of Search ..... 138/38, 39, 40; 51/436, 51/437, 439; 165/178, 180, 134, 183

[56] References Cited

U.S. PATENT DOCUMENTS

| | | | |
|---|---|---|---|
| 2,986,454 | 5/1961 | Jewett | 165/178 |
| 3,216,749 | 11/1965 | Summerfield | 165/178 X |
| 3,447,603 | 6/1969 | Jones | 165/178 |
| 3,504,739 | 4/1970 | Pearce | 165/158 |
| 3,707,186 | 12/1972 | Zorrilla | 165/134 |

*Primary Examiner*—Charles J. Myhre
*Assistant Examiner*—Theophil W. Streule, Jr.
*Attorney, Agent, or Firm*—Blakely, Sokoloff, Taylor & Zafman

[57] ABSTRACT

Replaceable inlet means for a fluid heat exchanger, particularly useful for a fluid containing an abrasive. A bulkhead is employed on the inlet side of the heat exchanger. A plurality of replaceable tubes are disposed within this bulkhead. The wear caused by the abrasive is confined to the replaceable tubes.

4 Claims, 4 Drawing Figures

REPLACEABLE INLET MEANS FOR HEAT EXCHANGER

BACKGROUND OF THE INVENTION

1. Field of the Invention

The invention relates to the field of heat exchangers, particularly those employed with fluids such as air, which fluids include an abrasive.

2. Prior Art

In some applications it becomes necessary to cool or heat fluids, such as air, where the fluids contain abrasives. If an ordinary heat exchanger is employed the abrasives will cause excessive wear, particularly at the inlet to the heat exchanger. Certain abrasives can substantially damage the heat exchanger and significantly shorten its useful life. For most heat exchangers it is impractical, or impossible, to repair the damage caused by the abrasive. Moreover, for many abrasives it is impossible to fabricate a heat exchanger which will not wear, particularly where hot fluids are employed.

While in the presently preferred embodiment of the invention the heat exchanger and its inlet means are employed for recovering heat from the fluid containing the abrasive, it will be apparent to one skilled in the art that the invented inlet means and heat exchanger may be employed in other applications. That is, heat recovery need not be the primary reason for employing the heat exchanger. In pollution control where particulate matter is removed from a fluid with bag filters, or the like, the fluid containing the matter may require cooling to prevent damage to the filters. In these applications the inlet means of the present invention is useful where the particulate matter (such as flue ash) is abrasive. Also the described invention may be employed where it is necessary to cool a fluid as part of a process for recovery of an abrasive.

As will be seen, the present invention provides a means for handling a fluid, which fluid contains an abrasive. Removable and replaceable inlet sections are employed.

SUMMARY OF THE INVENTION

Inlet means for a heat exchanger is described which means are particularly useful where the heat exchanger handles a fluid containing an abrasive. A bulkhead on the inlet side of the heat exchanger is used to mount a plurality of replaceable tubes. These hardened steel inlet tubes, slide through the bulkhead into sleeves, which sleeves are secured about the inlet ports of the heat exchanger. Wear caused by the abrasive entering the heat exchanger is confined to the replaceable tube. Moreover, the inlet tubes are of sufficient length to assure somewhat uniform flow within the heat exchanger, thereby preventing wear to the interior of the heat exchanger.

DETAILED DESCRIPTION OF THE INVENTION

Inlet means for a fluid heat exchanger is described. The inlet means are particularly useful where the heat exchanger must handle a fluid such as air which fluid contains an abrasive. In the following description, specific details of the presently preferred embodiment are given in order to provide a complete understanding of the invention. However, as will be obvious to one skilled in the art, the invention may be employed in a plurality of other applications.

Figure 1:
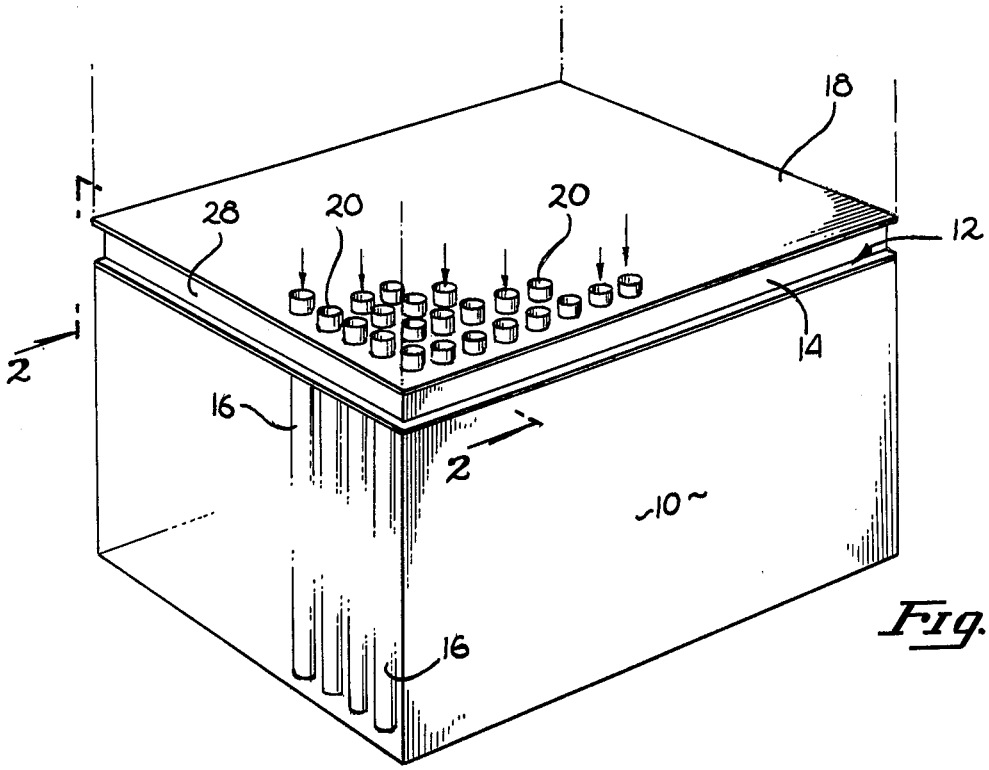
FIG. 1 is a perspective view of the heat exchanger and the inlet means of the present invention.
Figure 2:
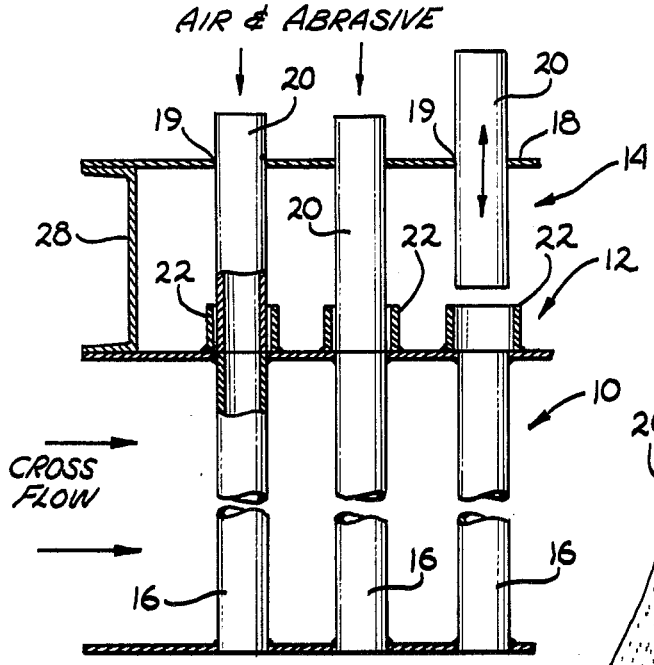
FIG. 2 is a partial, cross-sectional elevation view of the heat exchanger and inlet means of FIG. 1 taken generally through section line 2—2 of FIG. 1.

Referring to FIGS. 1 and 2, a heat exchanger 10 of somewhat conventional construction is illustrated. This heat exchanger includes a plurality of elongated metal tubes 16 which extend from the upper or inlet surface 12 of the heat exchanger to its lower, outlet surface. Fluid passes through the interior of the tubes 16 and is heated or cooled by a fluid passing transverse (cross flow) to the tube 16. In the presently preferred embodiment the fluid containing the abrasives passes through the interior of the tubes 16 with the cross flow fluid being employed to transfer or release heat.

In its presently preferred embodiment each section of the heat exchanger, such as the section shown in FIG. 1, is approximately 10 feet wide by 11 feet in length with each of the tubes 16 being approximately 10 feet long. Approximately 300 tubes 16 are employed in each section of the heat exchanger. In its presently preferred embodiment each section of the heat exchanger handles approximately 37,000 cfm of air containing an abrasive with an inlet temperature of approximately 700° F. It is readily apparent that the abrasive in the air will cause substantial wear, particularly on the inlet edges and surfaces of the tubes 16 if this air is supplied directly to the tubes 16. This wear is caused in part by the turbulence incident to the entry of air into the tubes. Moreover, as may be seen from the FIGURES, replacement of the inlet portions of the tubes 16 is impractical.

In the present invention a bulkhead 14 is disposed on the inlet surface or tube plate of the heat exchanger 10. This bulkhead includes an upper plate 18 which is spaced-apart from the upper surface 12 by a frame-like channel 28. The channel 28 and plate 18 may be ordinary metal members welded to form the bulkhead 14. In the presently preferred embodiment no cross flow occurs through the bulkhead 14.

A plurality of apertures 19 are disposed through the plate 18 in general axial alignment with each of the tubes 16. A sleeve 22 which may be an ordinary metal sleeve is secured to the inlet surface of the heat exchanger, again in alignment with each of the tubes 16. The sleeves 22 may be welded to the upper surface 12, or otherwise secured thereon. Thus, an aperture 19 and sleeve 22 are associated with each of the tubes 16 in alignment with such tubes.

A hardened steel inlet tube 20 is disposed within each of the apertures 19 and terminating in a sleeve 22. In the presently preferred embodiment the tubes 20 have approximately the same diameter as the tubes 16. The apertures 19 and sleeves 22 allow free passage of the tubes 20. Thus as may be readily seen from FIG. 2 each tube 20 may be readily removed and replaced.

Figure 3:
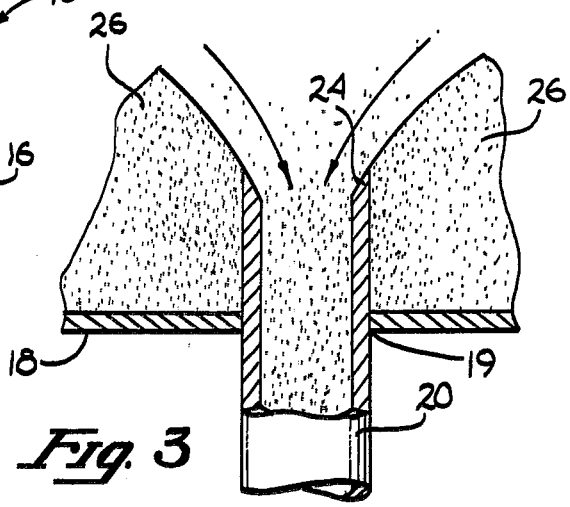
FIG. 3 is a cutaway, elevation view of a single inlet tube. This view is used to illustrate the manner in which the abrasive accumulates at the inlet tubes.

Each of the tubes 20 extends above the plate 18 a distance equal to the inside diameter of the tube 20, or a greater distance. This extension of the tubes 20 assures that the wear from the abrasive will be confined to the tubes 20. Also, as may be best seen in FIG. 3, the annular outer end of each tube includes a chamfer 24 for directing the flow of the fluid into the tubes 20. The abrasive 26 as shown in FIG. 3 accumulates about the portion of the tube 20 which extends above plate 18. The abrasive 26 tends to wear the chamfer 24 into an optimum angle. The abrasive 26 also forms a seal between the exterior of the tubes 20 and the apertures 19. The abrasive can be easily displaced to grasp tube 20 for removal and replacement.

In the presently preferred embodiment the overall length of each tube 20 is approximately equal to at least five times the inside diameter of the tubes. Typically, the fluid entering the tubes has a velocity component not in alignment with the tubes 16 and 20. This transverse velocity component will cause the abrasive to wear against the sides of the tubes 20. However, with the length of the tubes 20 being at least five times their inside diameter, this wear is substantially (if not completely) confined to the tubes 20, thereby preventing wear on the interior of the tubes 16.

The fluid containing the abrasive passes into tubes 20 and through the tubes 16. The cooling or heating of the fluid contained within the tubes 16 occurs from the cross flow within the heat exchanger 10. When excessive wear occurs on the tubes 20 they are readily removed from the sleeves 22 and apertures 19 and replaced. In this manner wear to the heat exchanger tubes 16 is prevented.

Figure 4:
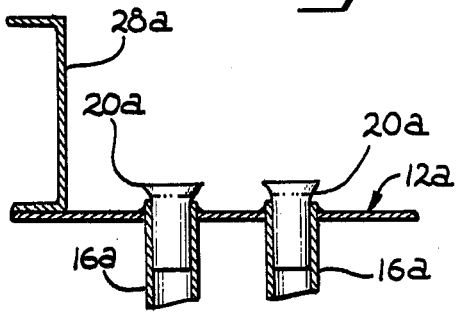
FIG. 4 is a partial, cross-sectional elevation view of the heat exchanger with alternate inlet means.

In FIG. 4 an alternate embodiment of replaceable tubes is shown mounted within tube 16*a*. In this embodiment a plate is not used on the channel members 28. Thus the inlet side 12*a* of the heat exchanger is exposed to the inlet flow. One end of each of the replaceable tubes 20*a* is flared to hold the tubes in place at one end of tubes 16*a*.

Thus, inlet means for a heat exchanger have been described which means are adaptable for accepting a fluid containing an abrasive. Wear caused by this abrasive is confined to the replaceable inlet means.

We claim:

1. In a heat exchanger having inlet means for accepting hot inlet fluids containing an abrasive, said heat exchanger including a plurality of elongated tubes of predetermined diameter and having its open ends disposed at a tube plate, the improvement comprising:

a bulkhead secured to said tube plate including a perforated upper plate;

a plurality of replaceable tubes, corresponding in number to the heat exchanger tubes, slidably positioned in said bulkhead upper plate and extending therethrough, each of said replaceable tubes having a length at least five times its diameter, the diameter of said replaceable tubes being substantially equal to the diameter of said heat exchanger tubes;

means cooperating with said replaceable tubes for positioning said replaceable tubes in said bulkhead for axial alignment with said heat exchanger tubes;

whereby said replaceable tubes are in substantially abutting relationship with said heat exchanger tubes.

2. The improvement of claim 1 wherein said replaceable tube positioning means comprises a sleeve secured to said tube plate about the heat exchanger tube, said sleeve having an aperture for receiving one end of said replacement tube.

3. The improvement according to claim 1 wherein said replacement tube comprises hardened steel.

4. The improvement according to claim 1 wherein said replaceable tube extends above the upper plate of said bulkhead and includes an inwardly tapered portion at its upper end.

* * * * *